US006508671B2

(12) United States Patent
Ko

(10) Patent No.: US 6,508,671 B2
(45) Date of Patent: Jan. 21, 2003

(54) POWER CABLE ASSEMBLY

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/047,637

(22) Filed: Oct. 26, 2001

(65) Prior Publication Data

US 2002/0081904 A1 Jun. 27, 2002

Related U.S. Application Data

(63) Continuation-in-part of application No. 09/661,169, filed on Sep. 13, 2000, now Pat. No. 6,341,986.

(51) Int. Cl.[7] ..... H01R 13/648
(52) U.S. Cl. ..... 439/610; 439/686; 439/447
(58) Field of Search ..... 439/610, 607–609, 439/98, 686, 695, 680, 447

(56) References Cited

U.S. PATENT DOCUMENTS 5,941,733 A * 8/1999 Lai ..... 439/610
6,017,245 A * 1/2000 Karir ..... 439/610
6,135,815 A * 10/2000 Ko et al. ..... 439/607
6,210,230 B1 * 4/2001 Lai ..... 439/610

* cited by examiner

*Primary Examiner*—Hien Vu
(74) *Attorney, Agent, or Firm*—Wei Te Chung

(57) ABSTRACT

A power cable assembly (100")comprises a cable and an electrical connector. The connector includes an insulative housing (10"), a plurality of terminals secured in the housing, a conductive rear shell (52"), a conductive front shell (51"), and a rear cover (60"). The housing comprises a block, a plurality of silos (14") formed in arrays. The conductive rear shell fittedly engages with the block of the housing. The conductive front shell is attached to the conductive rear shell and has a front portion (513") enclosing the silos of the housing. The rear cover defines a cavity moveable receiving the block of the housing and the conductive rear shell therein.

2 Claims, 12 Drawing Sheets

POWER CABLE ASSEMBLY

RELATED APPLICATION

The application is a continuation-in-part (C-I-P) application of the application Ser. No. 09/661,169 filed on Sep. 13, 2000, now U.S. Pat. No. 6,341,986.

BACKGROUND OF THE INVENTION

1. Field of the Invention

The present invention relates to a power cable assembly, and particularly to a power cable assembly meeting SSI (Server System Infrastructure) standard requirements and which is easy to assemble.

2. Description of Related Art

Applicant's earlier granted U.S. Pat. No. 6,135,815 discloses a power cable assembly comprising an insulative housing, a plurality of power terminals received in the housing, and a cable having a plurality of conductive wires terminated to corresponding power terminals. An insulative cover for enclosing the conductive wires is further over-molded around the housing. However, over-molding an insulative cover over a housing is not suitable for mass production. Hence, an improved power cable assembly is required to simplify manufacture and reduce cost.

SUMMARY OF THE INVENTION

Accordingly, a first object of the present invention is to provide a power cable assembly that is easy to manufacture and assemble, thereby reducing cost.

A second object of the present invention is to provide a power cable assembly having a pair of separate shells for improved shielding of the connector.

A power cable assembly in accordance with the present invention comprises a cable having a plurality of conductive wires therein and an electrical connector electrically connected to an end of said cable. The connector includes an insulative housing, a plurality of terminals, a conductive rear shell, a conductive front shell, and a rear cover. The housing comprises a block, a plurality of silos formed in arrays at a front face of the block. A passageway is defined in each silo and extending through the block. The terminals each correspondingly electrically connect to a conductive wire of the cable and are securely received within a corresponding passageway of the housing. The conductive rear shell fittedly engages with the block of the housing. The conductive front shell is attached to the conductive rear shell and has a front portion enclosing the silos of the housing. The rear cover defines a cavity moveable receiving the block of the housing and the conductive rear shell therein.

Other objects, advantages and novel features of the invention will become more apparent from the following detailed description of the present embodiment when taken in conjunction with the accompanying drawings.

DETAILED DESCRIPTION OF THE INVENTION

Figure 1:
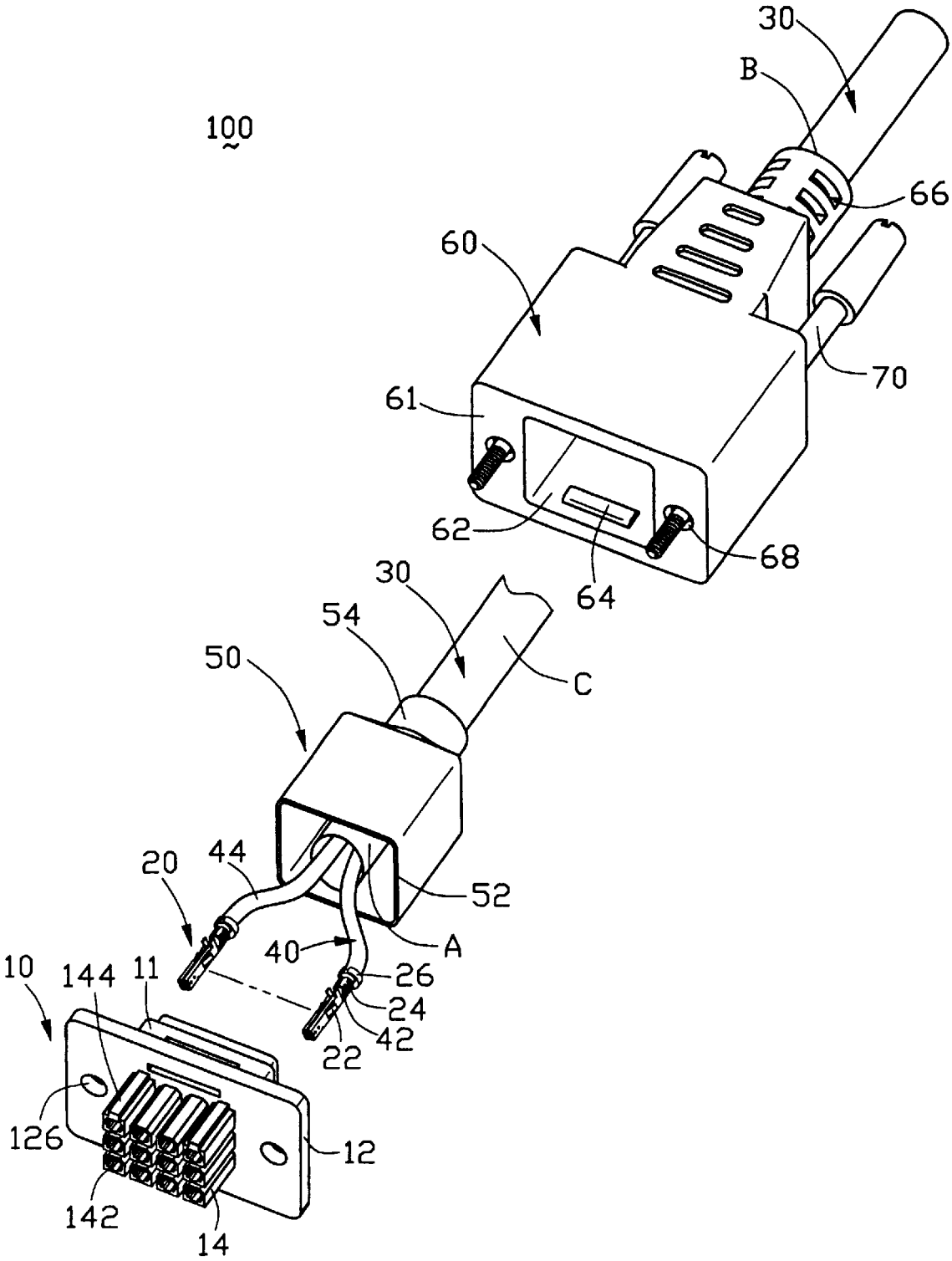
FIG. 1 is a partly exploded view of a power cable assembly in accordance with a first embodiment of the present invention with a cable thereof being severed for clarify.

Referring to FIG. 1, a power cable assembly 100 in accordance with a first embodiment of the present invention comprises an insulative housing 10, a plurality of conductive terminals 20, a cable 30 comprising a plurality of wires 40 (only two shown for simplicity) each of which is terminated to a corresponding terminal 20, a conductive shell 50 used as EMI (Electrical Magnetic Interference) shield surrounding the cable 30, a pre-molded rear cover 60, and an interlocking means being formed on the housing 10, the EMI shell 50 and the rear cover 60 for securely assembling the housing 10, the EMI shell 50 and the rear cover 60 together.

Figure 2:
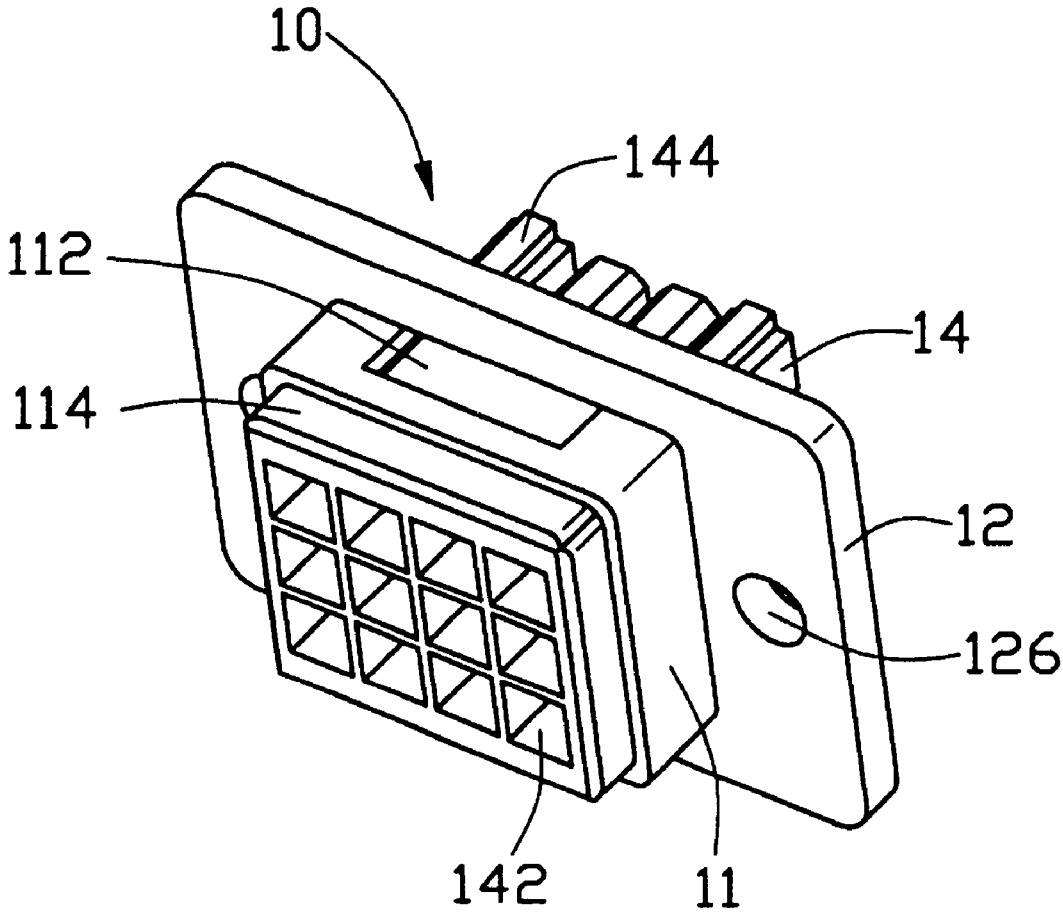
FIG. 2 is a perspective view of a housing of the power cable assembly shown in FIG. 1.

Also referring to FIG. 2, the housing 10 comprises a rectangular block 11 formed at a rear end thereof and a plurality of silos 14 arranged in arrays and columns and formed at a front end of the block 11, with a passageway 142 defined through each silo 14 and extending through the block 11. The block 11 forms a flange 12 around the front end of the block 11. The flange 12 defines a pair of through holes 126 at opposite ends thereof. Two outermost silos 14 in an upper array each form a key 144 on an upper face thereof for ensuring correct engagement of the silos 14 of the housing 10 with a corresponding structure of a complementary connector (not shown).

Each terminal 20 has the shape of a rectangular tube and comprises a pair of tabs 22 adjacent to a forward end thereof for securely engaging with inner walls (not labeled) of a corresponding passageway 142 of the housing 10. A ferrule 26 at a rear end of each terminal 20 is used for clamping a jacket 44 of the wire 40 of the cable 30, and a wing 24 between the tabs 22 and the ferrule 26 clamps and establishes an electrical connection with a conductor 42 of the wire 40 of the cable 30.

The EMI shell 50 is rectangular in shape and comprises a ferrule 54 at a rear end thereof for firmly clamping the cable 30. The cable 30 extends into the shell 50 from the rear end of the shell 50. The wires 40 of a segment A of the cable 30, together with the terminals 20 attached thereto, extend outside of the front portion 52 of the shell 50.

The pre-molded rear cover 60 comprises a front face 61, a cavity 62 defined in the front face 61, and a boot 66 at a rear end thereof. A segment B of the cable 30 passes through the boot 66 and a segment C of the cable 30 extends into the cavity 62. The boot 66 can prevent the segment B of the cable 30 from rotating and from moving forward and rearward. The pre-molded rear cover 60 further defines a pair of retaining holes 68 extending from a rear end to the front face 61 of the rear cover 60.

The interlocking means in the first embodiment comprises a rabbet groove 114 at a rear end of the block 11 of the housing 10, a front portion 52 at a forward end of the shell 50, a pair of recesses 112 in upper and lower faces of the block 11 of the housing 10 and a pair of ribs 64 being respectively formed on an upper and a lower inner faces of the cavity 62.

The power cable assembly 100 further comprises a pair of screws 70 for securely connecting the power cable assembly 100 to a complementary connector.

Figure 3:
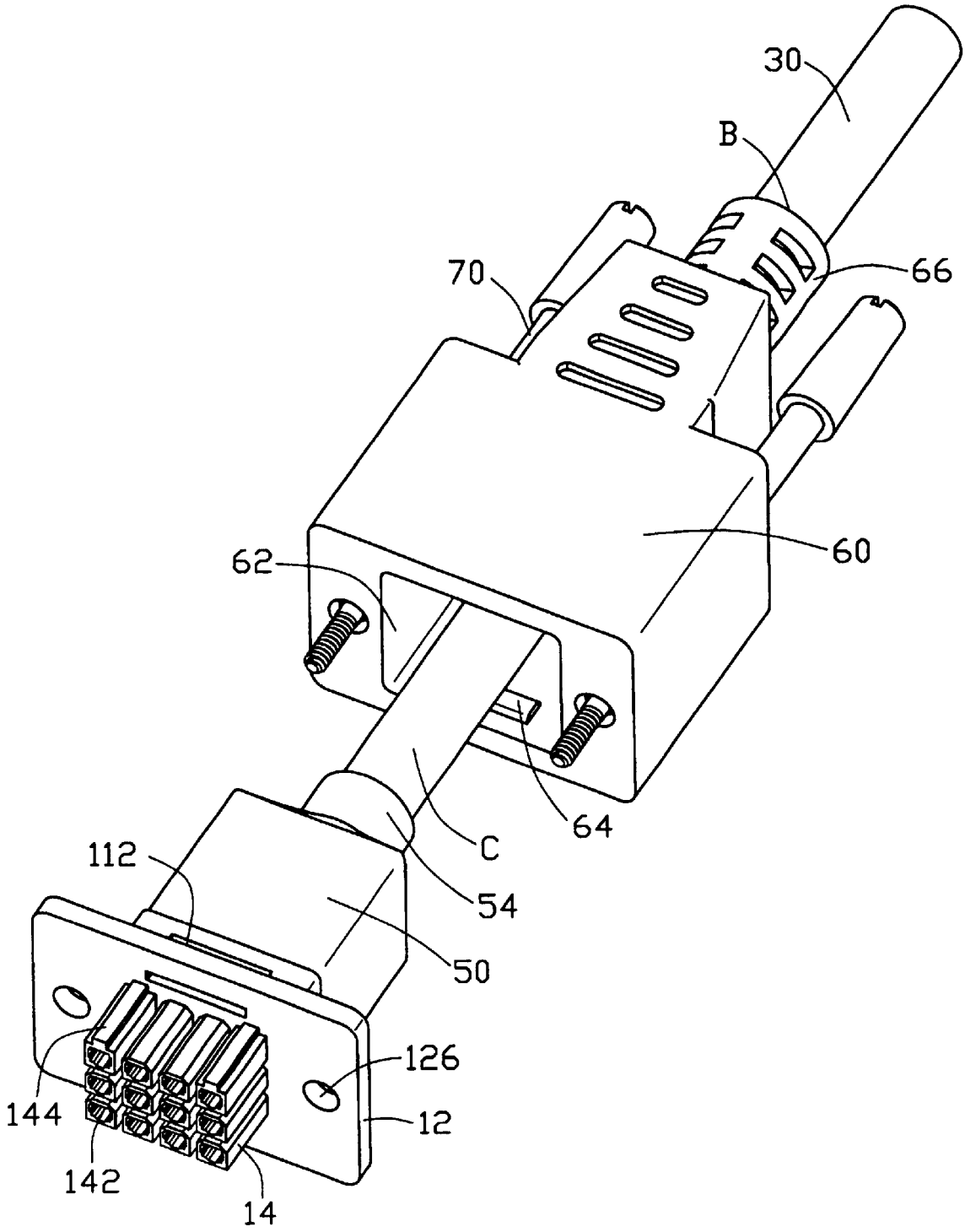
FIG. 3 is a partly assembled view of FIG. 1.

Referring to FIG. 3, in assembly, the terminals 20 are first inserted into corresponding passageways 142 of the housing 10 from the rear end of the block 11 and the tabs 22 of each terminal 20 are securely engaged with inner walls of each corresponding passageway 142.

The front portion 52 of the shell 50 is fittedly engaged with the rabbet groove 114 of the block 11 of the housing 10. The ferrule 54 of the shell 50 is clamped to the cable 30 to form a strain relief for preventing the segment A of the cable 30 from rotating and moving forward and rearward.

The pair of the screws 70 is inserted into the retaining holes 68 of the pre-molded rear cover 60.

Figure 4:
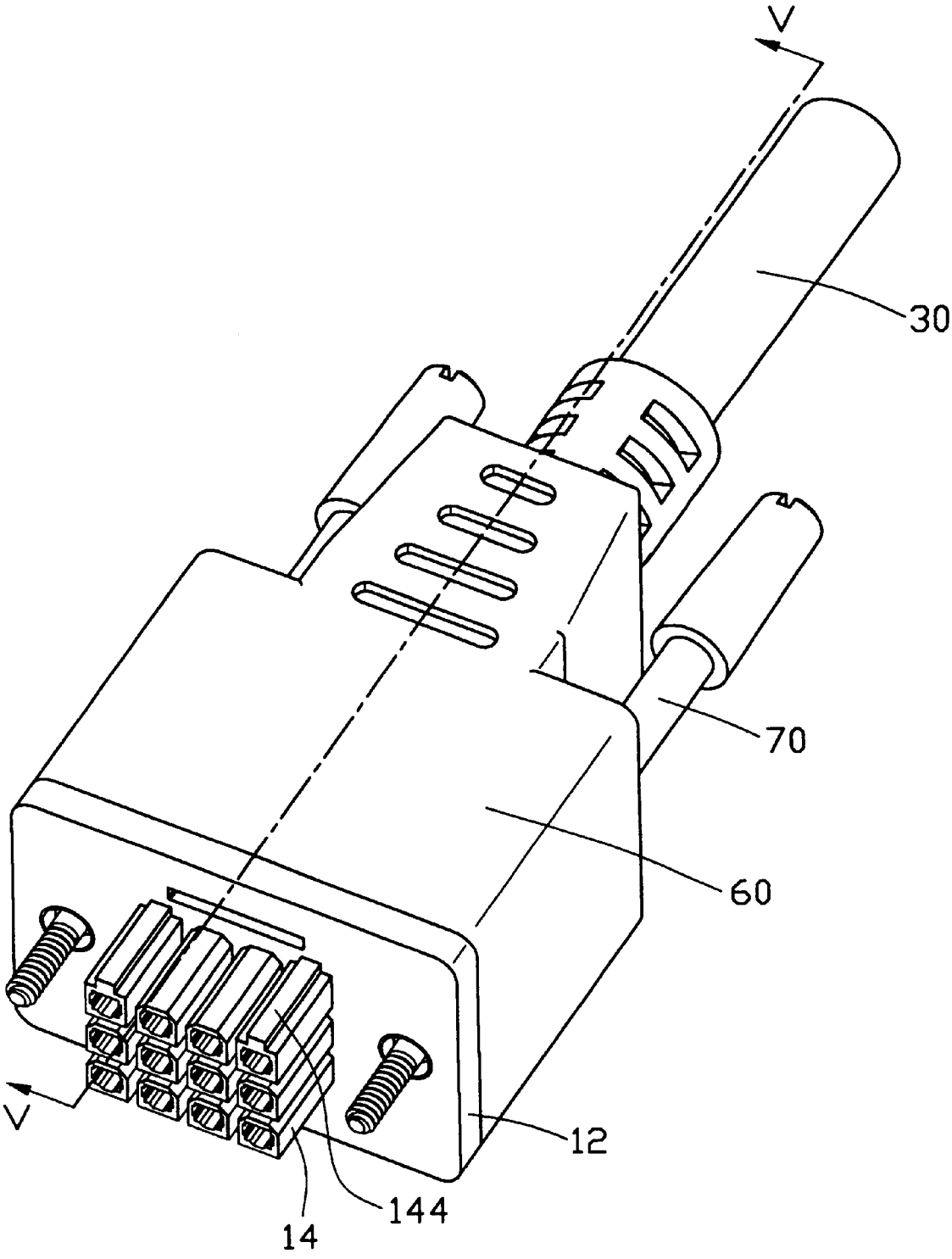
FIG. 4 is an assembled view of FIG. 1.
Figure 5:
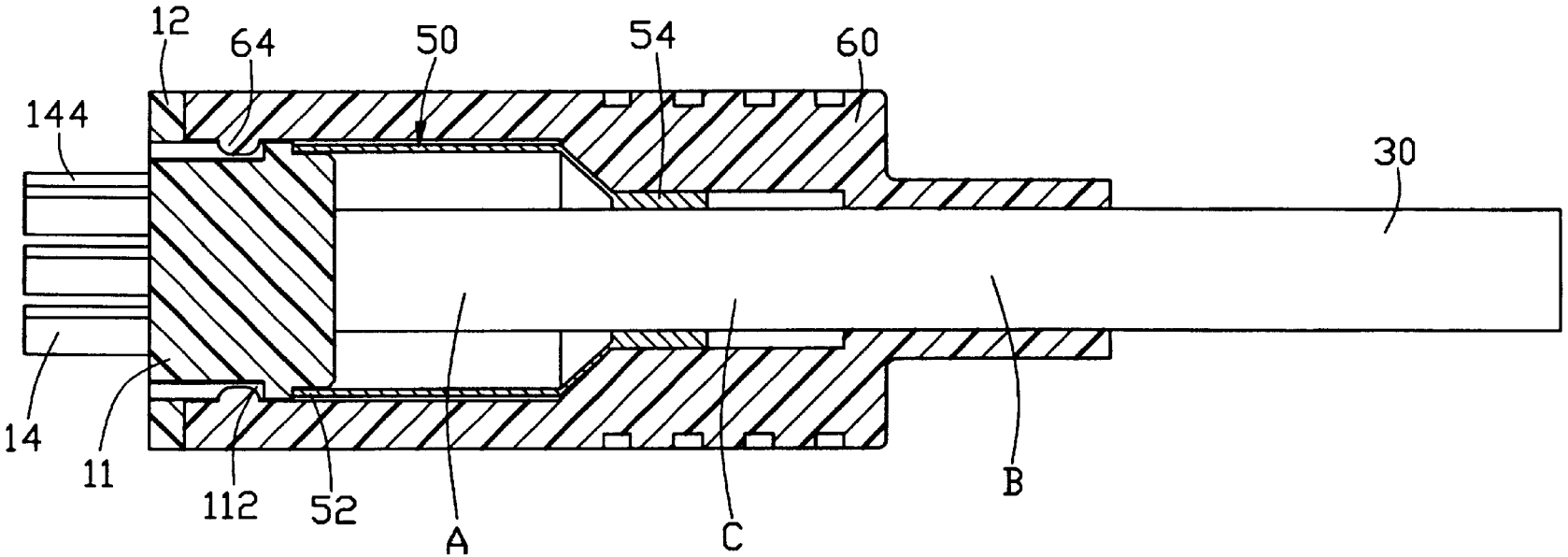
FIG. 5 is a cross-sectional view taken along line 5—5 of FIG. 4.

Referring to FIGS. 4 and 5, the pre-molded rear cover 60 is moved forwardly relative to the cable 30 with the pair of ribs 64 of the pre-molded rear cover 60 being correspondingly received in the pair of recesses 112 of the housing 10 thereby securely assembling the housing 10 with the shell 50 to the cavity 62 of the pre-molded rear cover 60. At the same time, front ends of the pair of screws 70 extend through the through holes 126 of the housing 10 for engaging with the complementary connector.

Figure 6:
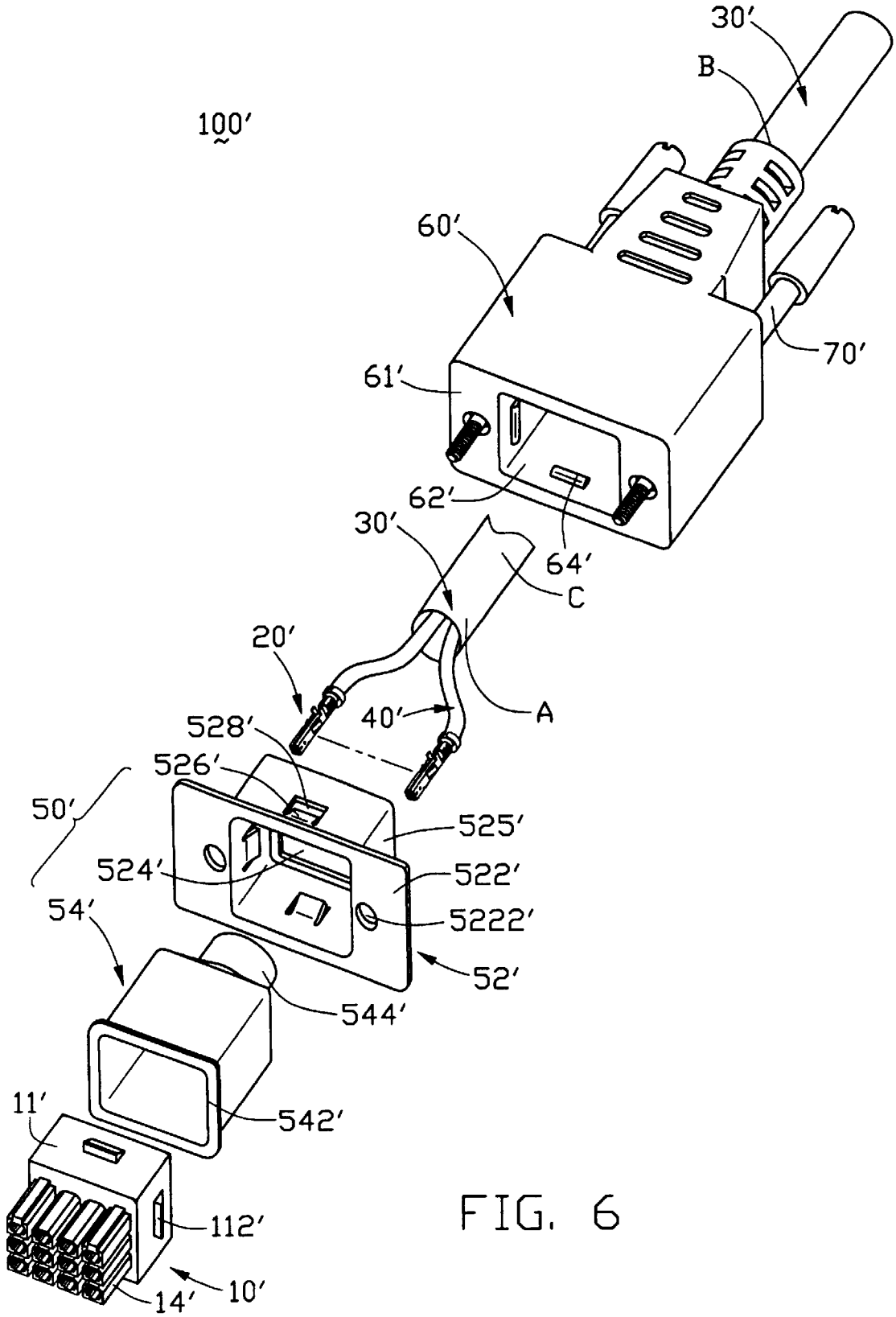
FIG. 6 is a partly exploded view of a power cable assembly in accordance with a second embodiment of the present invention with a cable thereof being severed for clarify.
Figure 7:
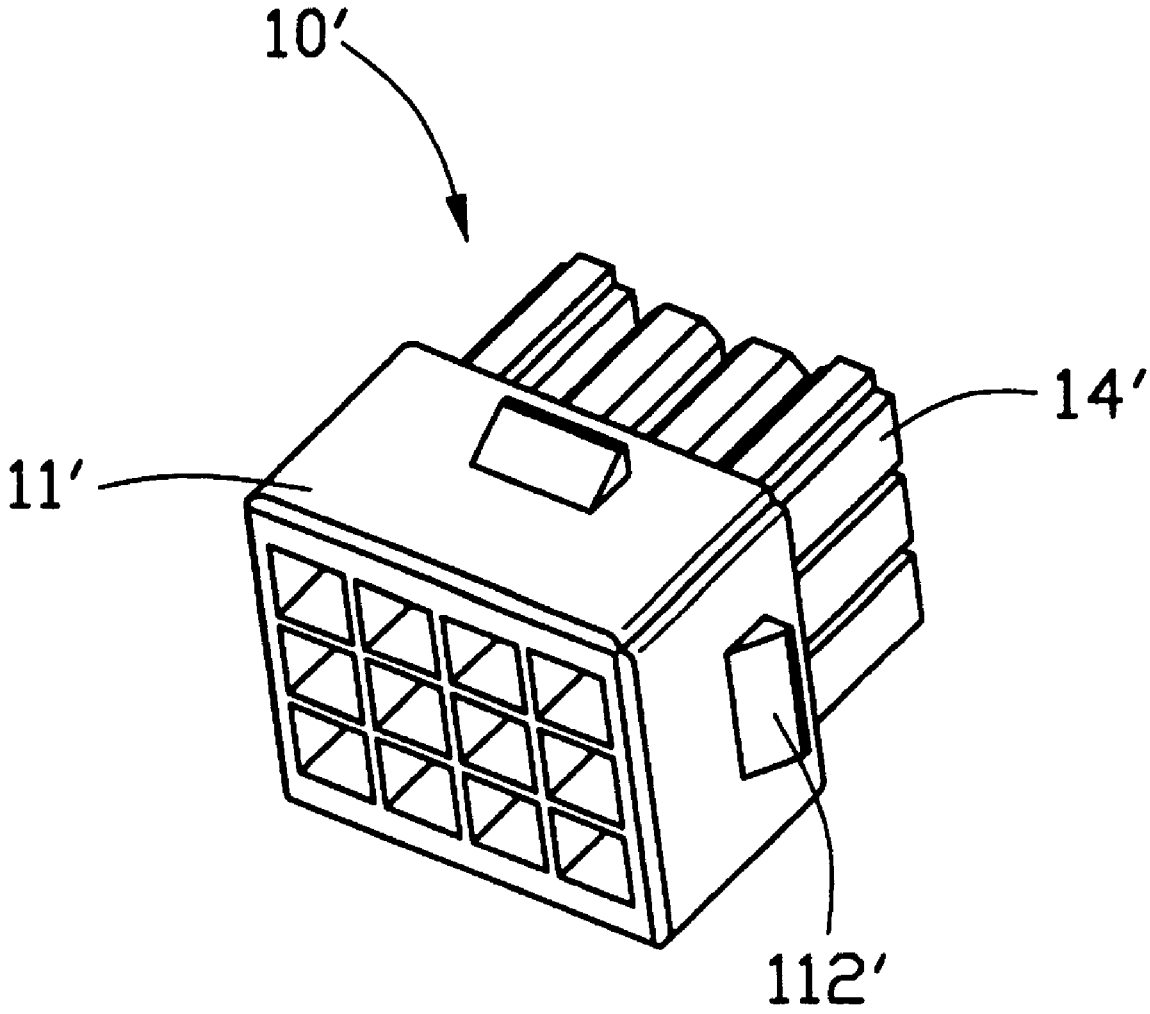
FIG. 7 is a perspective view of a housing of the power cable assembly shown in FIG. 6, viewed from a different aspect.

Referring to FIGS. 6 and 7, in a second embodiment of the power cable assembly 100' of the present invention, an insulative housing 10' comprises a block 11' and a plurality of silos 14' arranged in arrays and columns and formed on a front face of the block 11'.

An EMI shield 50' comprises a conductive front shell 52' and a conductive rear shell 54'. The front shell 52' comprises a flange 522' formed at a front end thereof and has an opening 524' defined at a rear end thereof. The flange 522' defines a pair of through holes 5222' at opposite sides thereof. The rear shell 54' comprises a flange 542' formed at a front end thereof and a ferrule 544' at a rear end thereof.

The interlocking means in the second embodiment of the present invention comprises two pairs of first ribs 112' separately formed on four outer faces of the block 11' of the housing 10', two pairs of tongues 526' punched from four side walls 525' of the front shell 52', two pairs of recesses 528' defined by the tongues 526' as the tongues 526' extend away from the four side walls of the front shell 52', and two pairs of second ribs 64' being respectively formed on four inner faces of the cavity 62' of the rear cover 60'.

Figure 8:
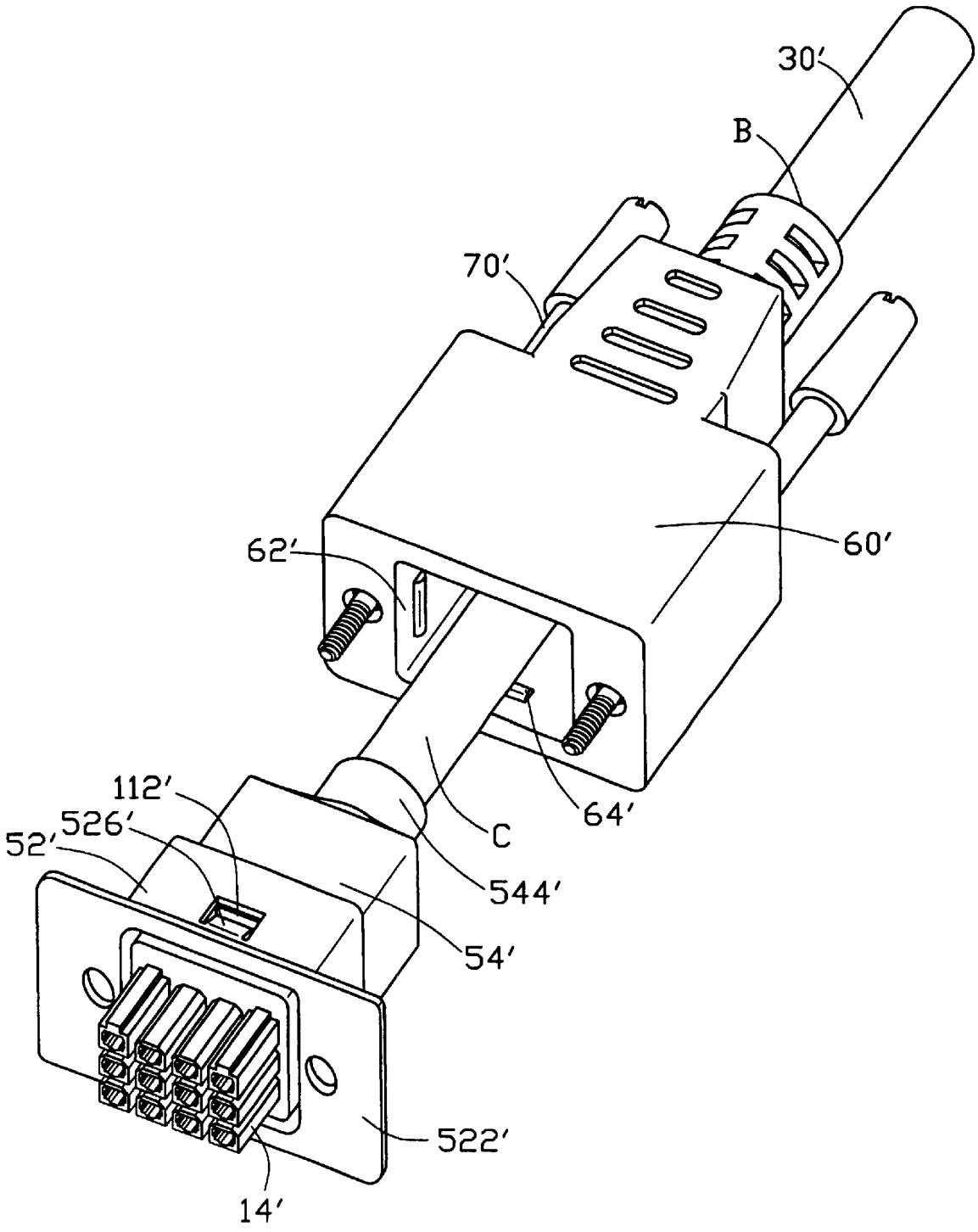
FIG. 8 is a partly assembled view of FIG. 6.

Referring to FIG. 8, in assembly, the rear shell 54' is inserted into the front shell 52' from a front side thereof and through the opening 524' until a rear face of the flange 542' is seated against a front face of a flange (not labeled) at the rear of the front shell, said flange defining the perimeter of the opening 524'. A cable 30' is extended through the rear shell 54' and the front shell 52' via the ferrule 544'. The plurality of terminals 20' attached to wires 40' of the cable 30' are then inserted and secured in the silos 14' of the housing 10'. The housing 10' is inserted into the front shell 52' from the front end of the front shell 52' until the first ribs 112' of the block 11' slide past and abut against the tongues 526' of the front shell 52'. The ferrule 544' of the rear shell 54' is then fixedly clamped to the cable 30'.

Figure 9:
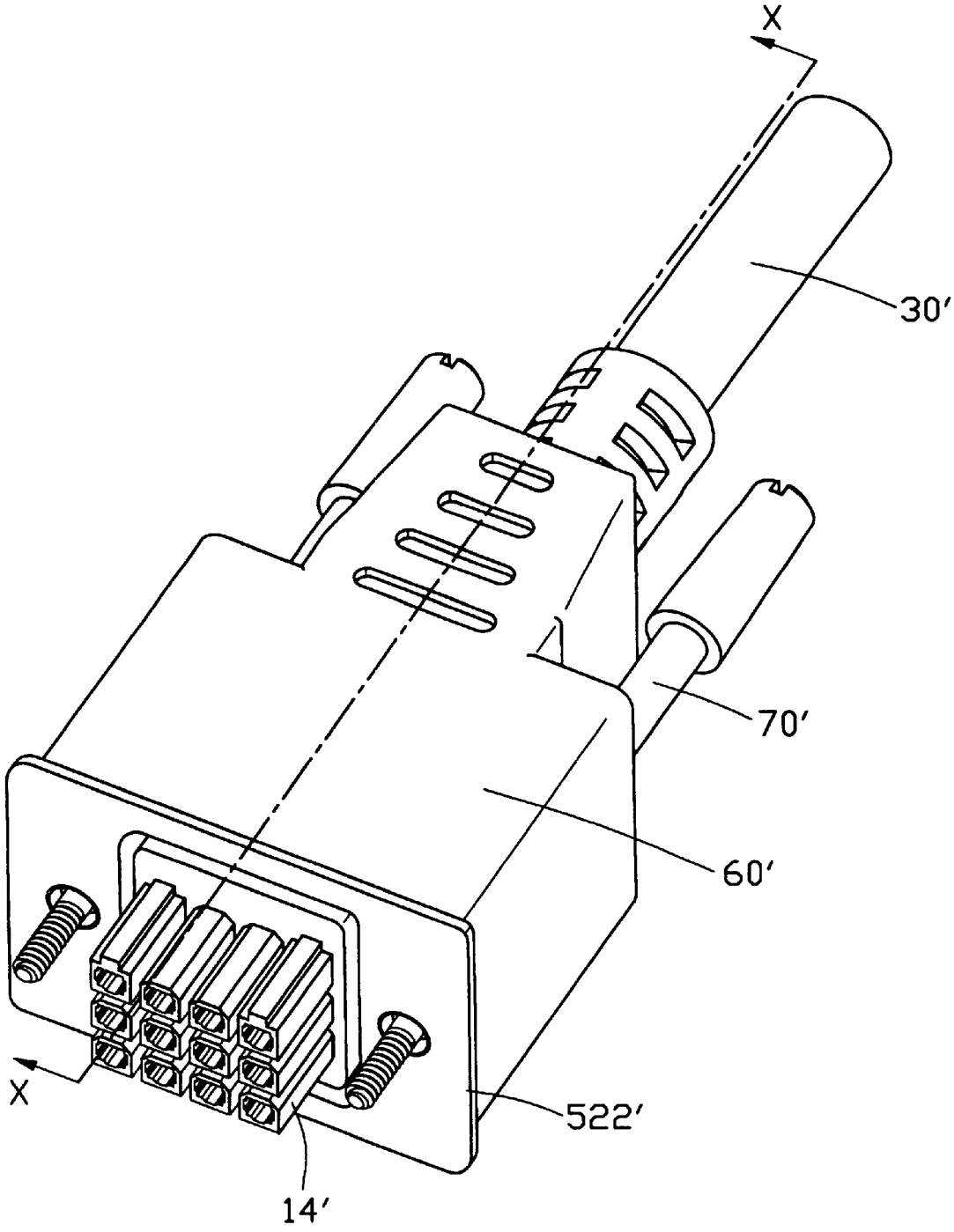
FIG. 9 is an assembled view of FIG. 6.
Figure 10:
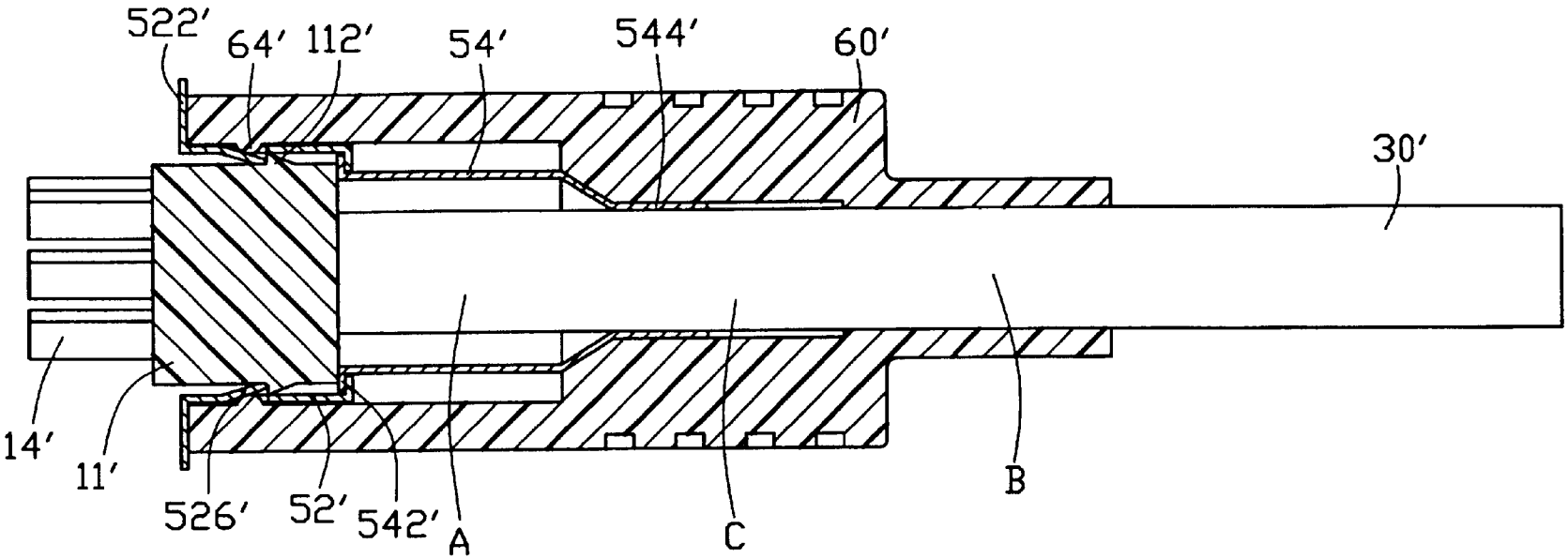
FIG. 10 is a cross-sectional view taken along line 10—10 of FIG. 9.

Referring to FIGS. 9 and 10, the rear cover 60' is moved forwardly relative to the cable 30' with the second ribs 64' of the rear cover 60' being correspondingly received in the recesses 528' of the front shell 52' and a front face 61' of the rear cover 60' abutting against the flange 522' of the front shell 52' thereby securely assembling the rear cover 60', the front shell 52' and the housing 10' together. At the same time, front ends of the pair of screws 70' extend through the through holes 5222' of the front shell 52' for engaging with the complementary connector.

Figure 11:
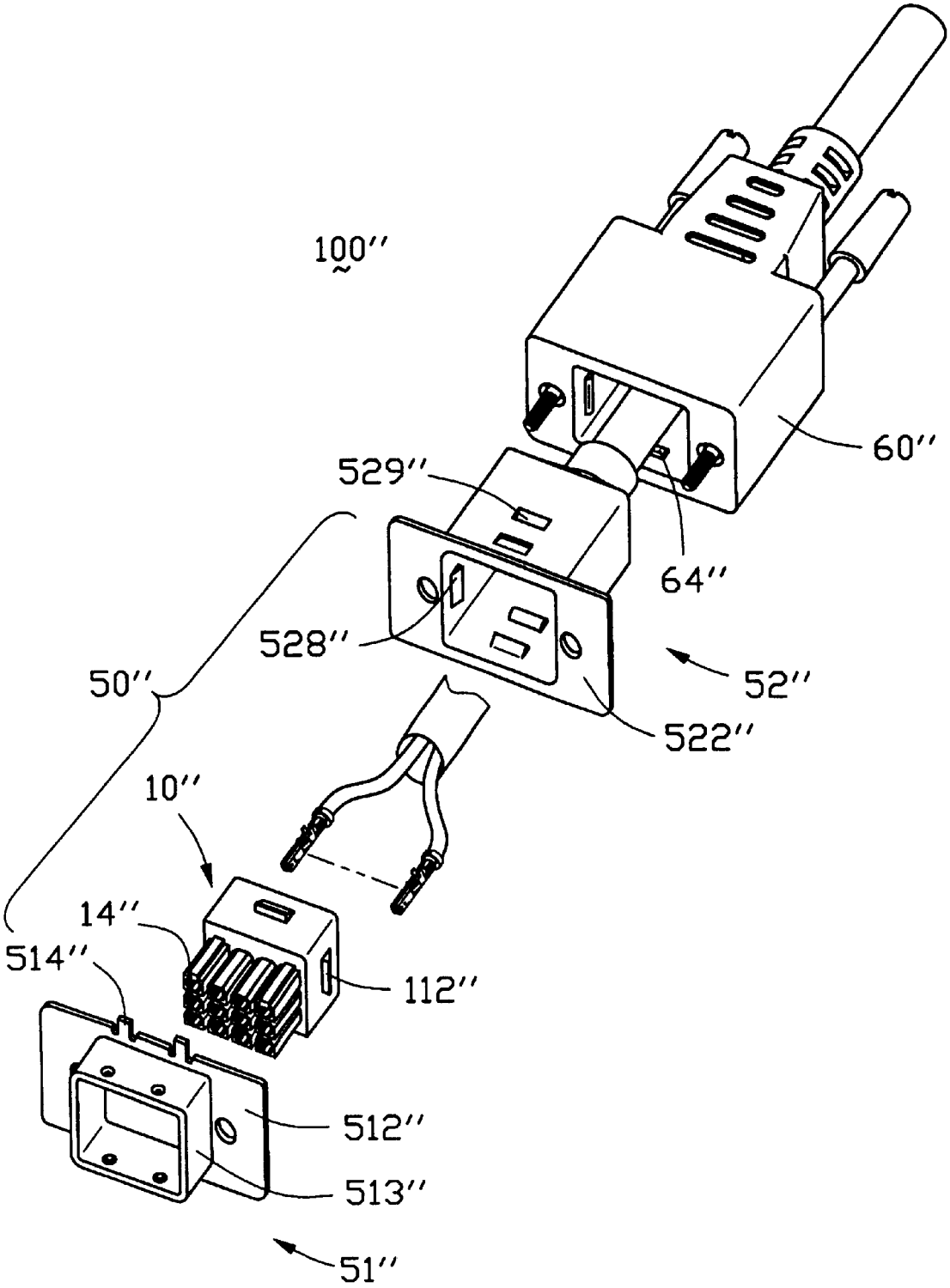
FIG. 11 is a partly exploded view of a power cable assembly in accordance with a third embodiment of the present invention with a cable thereof being severed for clarify.

Referring to FIG. 11, in a third embodiment of the present invention, a power cable assembly 100" comprises an EMI shield assembly 50" different from the EMI shell 50 of the power cable assembly 100 in the first embodiment. The EMI shield comprises a conductive front shell 51" and a conductive rear shell 52". The conductive rear shell 52" comprises a flange 522" at a front end thereof. Two pairs of first recesses 528" are defined on an upper, lower, and a pair of side walls of the conductive rear shell and a pair of second recesses 529" is defined on the upper and lower side walls of the conductive rear shell 52". The conductive front shell 51" comprises a flange 512" and a front portion 513" projecting from the flange 512" for enclosing silos 14" of a housing 10". A plurality of bars 514" extends upwardly and downwardly from the flange 512".

Figure 12:
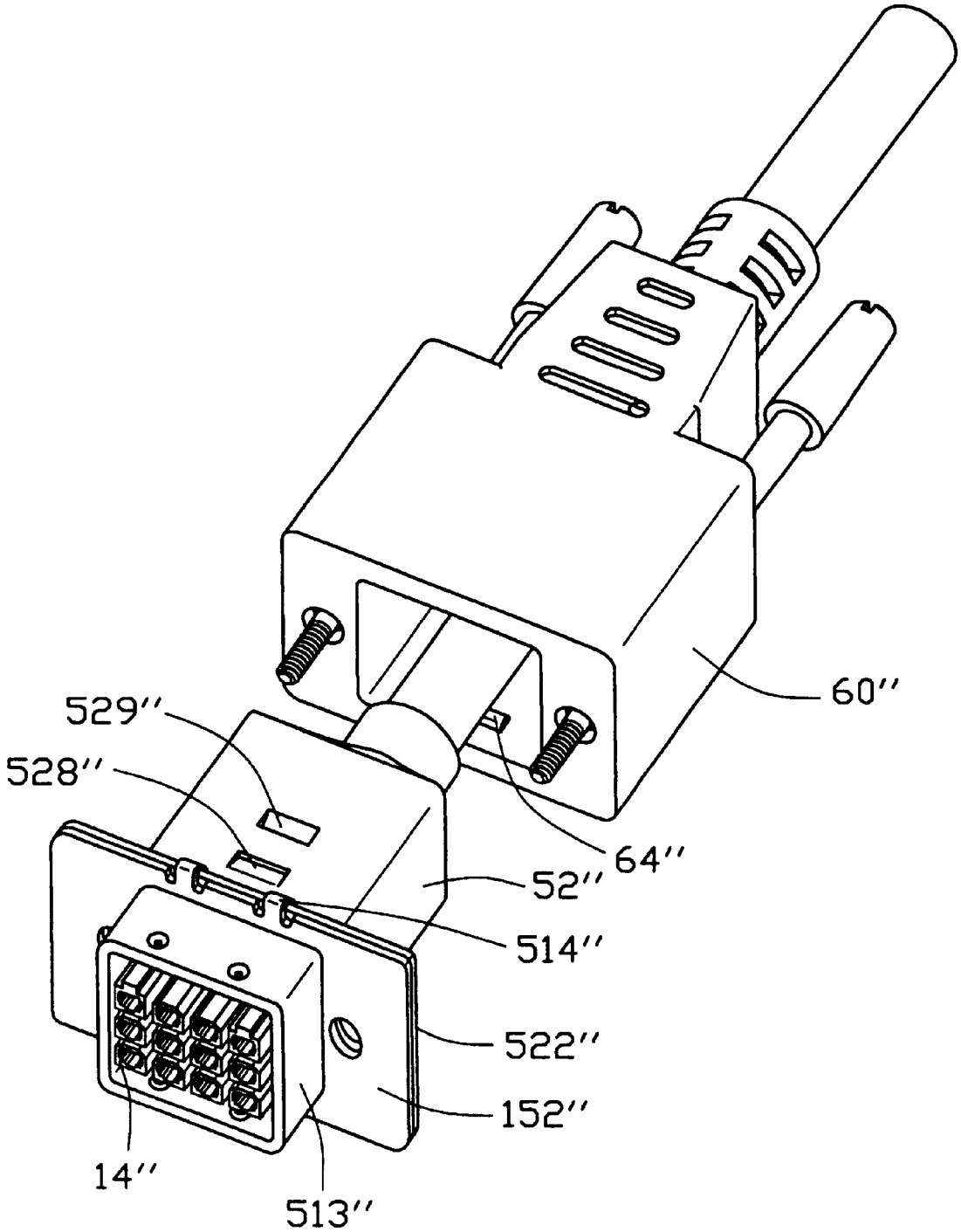
FIG. 12 is a partly assembled view of the power cable assembly of the third embodiment of the present invention.

Referring to FIG. 12, in assembly, first ribs 112" of the housing 10" are assembled into the first recesses 528". The bars 514" of the conductive front shell 51" are bent to engage with the flange 522" of the conductive rear shell 52" whereby the front portion 513" of the conductive front shell 51" encloses the silos 14" of the housing 10". Finally, a rear cover 60" is moved forwardly relative to a cable 30" whereby ribs of a rear cover 60" are received into the second recesses 529" of the conductive rear shell 52" to secure the housing 10", the conductive front shell 51" and the conductive rear shell 52" to the rear cover 60".

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly for mating with a complementary connector, comprising:

a cable having a plurality of conductive wires therein; and an electrical connector electrically connected to an end of said cable, said connector including:

an insulative housing comprising a block, a plurality of silos formed in arrays at a front face of the block, a passageway defined in each silo and extending through the block;

a plurality of terminals each correspondingly electrically connected to a conductive wire of the cable and securely received within a corresponding passageway of the housing;

a conductive rear shell fittedly engaging and enclosing the block of the housing;

a conductive front shell electrically connected to the conductive rear shell and having a front portion enclosing the silos of the housing;

a rear cover defining a cavity therein, the rear cover being moveable along the cable so as to receive the block of the housing and the conductive rear shell within the cavity; wherein the conductive rear shell has a flange at a front end thereof and a ferrule at a rear end thereof fixedly cramping the cable to form a strain relief for preventing the cable from rotating and moving forward and rearward; wherein the conductive front shell has a flange engaging with the flange of the conductive rear shell; wherein the flange of the conductive front shell has a plurality of engaging bars engaging with the flange of the conductive rear shell; wherein a plurality of pairs of first ribs is separately formed on outer faces of the block of the housing, a plurality of pairs of first recesses is defined in the side walls of the conductive rear shell, the first ribs can be respectively securely received into the first recesses; wherein a plurality of pairs of second ribs is formed on inner faces of the cavity of the rear cover, a plurality of pairs of second recesses is defined in the side walls of the conductive rear shell adjacent to the first recesses, the second ribs can be respectively securely received into the second.

2. The cable assembly as claimed in claim 1, wherein two outermost silos in an upper array each have a key for ensuring the silos correctly mate with the complementary connector.

* * * * *